US008151805B2

(12) United States Patent
Takeda et al.

(10) Patent No.: US 8,151,805 B2
(45) Date of Patent: Apr. 10, 2012

(54) CIGARETTE WITH THE AMOUNT OF SIDESTREAM SMOKE REDUCED

(75) Inventors: Kazuko Takeda, Yokohama (JP); Yoshiyuki Yamada, Yokohama (JP)

(73) Assignee: Japan Tobacco Inc., Tokyo (JP)

( * ) Notice: Subject to any disclaimer, the term of this patent is extended or adjusted under 35 U.S.C. 154(b) by 739 days.

(21) Appl. No.: 10/941,934

(22) Filed: Sep. 16, 2004

(65) Prior Publication Data

US 2005/0087203 A1 Apr. 28, 2005

Related U.S. Application Data

(63) Continuation of application No. PCT/JP03/02430, filed on Mar. 3, 2003.

(30) Foreign Application Priority Data

Mar. 18, 2002 (JP) ..... 2002-074943

(51) Int. Cl.

| | |
|---|---|
| ***A24D 1/02*** | (2006.01) |
| ***D21H 11/00*** | (2006.01) |
| ***D21H 13/00*** | (2006.01) |
| ***D21H 15/00*** | (2006.01) |
| ***D21H 17/00*** | (2006.01) |
| ***D21H 19/00*** | (2006.01) |
| ***D21H 21/00*** | (2006.01) |
| ***D21H 23/00*** | (2006.01) |
| ***D21H 25/00*** | (2006.01) |
| ***D21H 27/00*** | (2006.01) |

(52) U.S. Cl. ..... 131/365; 131/360; 131/336; 131/331; 162/139

(58) Field of Classification Search ..... None
See application file for complete search history.

(56) References Cited

U.S. PATENT DOCUMENTS

| | | | | | |
|---|---|---|---|---|---|
| 4,615,345 | A | * | 10/1986 | Durocher | 131/365 |
| 4,622,983 | A | * | 11/1986 | Mathews et al. | 131/365 |
| 4,998,543 | A | * | 3/1991 | Goodman et al. | 131/365 |
| 5,143,098 | A | | 9/1992 | Rogers et al. | |
| 5,152,304 | A | * | 10/1992 | Bokelman et al. | 131/365 |
| 5,154,191 | A | * | 10/1992 | Owens, Jr. | 131/365 |
| 5,540,242 | A | * | 7/1996 | Chao et al. | 131/365 |
| 5,709,228 | A | * | 1/1998 | Cohen et al. | 131/365 |
| 5,921,249 | A | * | 7/1999 | Hampl, Jr. | 131/365 |
| 6,138,684 | A | * | 10/2000 | Yamazaki et al. | 131/365 |
| 2003/0136420 | A1 | * | 7/2003 | Kraker | 131/360 |

FOREIGN PATENT DOCUMENTS

| | | | |
|---|---|---|---|
| EP | 0 403 129 | A2 | 12/1990 |
| JP | 60-59199 | A | 4/1985 |
| JP | 3-33299 | A | 2/1991 |
| JP | 11-124798 | A | 5/1999 |

* cited by examiner

*Primary Examiner* — Richard Crispino
*Assistant Examiner* — Phu H Nguyen
(74) *Attorney, Agent, or Firm* — Birch, Stewart, Kolasch & Birch, LLP

(57) ABSTRACT

A cigarette is provided with a tobacco section including a tobacco filler rod wrapped with an inner wrapper paper sheet containing less than 4% by weight of calcium carbonate and an outer wrapper paper containing calcium carbonate in an amount of 30 g/m$^2$ and a burn adjusting agent in an amount of 3% by weight or more.

8 Claims, No Drawings

CIGARETTE WITH THE AMOUNT OF SIDESTREAM SMOKE REDUCED

CROSS REFERENCE TO RELATED APPLICATIONS

This is a Continuation Application of PCT Application No. PCT/JP03/02430, filed Mar. 3, 2003, which was published under PCT Article 21(2) in Japanese.

This application is based upon and claims the benefit of priority from prior Japanese Patent Application No. 2002-074943, filed Mar. 18, 2002, the entire contents of which are incorporated herein by reference.

BACKGROUND OF THE INVENTION

1. Field of the Invention

The present invention relates to a cigarette whose sidestream smoke amount reduced, and more specifically to a cigarette wrapped with an inner wrapper paper sheet and an outer wrapper paper sheet.

2. Description of the Related Art

Various techniques have been proposed in order to reduce the amount of sidestream smoke of cigarettes. For example, Japanese Patent No. 2572488 discloses a cigarette wrapped with an inner wrapper paper sheet having an air permeability of 1 to 5 CORESTA units and containing 1 to 8% by weight of a loading material (for example, calcium carbonate) and an outer wrapper paper sheet having a basis weight of 35 to 65 g/m$^2$ and containing 18 to 40% by weight of a loading material (for example, calcium carbonate). Further, Jap. Pat. Appln. KOKAI Publication No. 6-7141 discloses a cigarette wrapped with an inner wrapper paper sheet containing a magnesium-containing loading material and an outer wrapper paper sheet containing an additive package of alkali metal ions, alkaline-earth metal ions, inorganic anions and organic anions.

Each of the conventional cigarettes has a slow burn rate and therefore a small amount of sidestream smoke per unit time. However it has been found that these cigarettes entail a problem of a large amount of sidestream smoke per cigarette.

Accordingly, an object of the present invention is to provide a cigarette which is small not only in an amount of sidestream smoke per unit time, but also in an amount of sidestream smoke per cigarette.

BRIEF SUMMARY OF THE INVENTION

The above-described object of the present invention has been achieved by studying the wrapper paper itself that wraps cigarettes without providing a filter or technically improving the tobacco filler material (for example, cut tobacco).

Thus, according to the present invention, there is provided a cigarette characterized by comprising a tobacco section including a tobacco filler rod wrapped with an inner wrapper paper sheet containing less than 4% by weight of calcium carbonate and an outer wrapper paper containing calcium carbonate in an amount of 30 g/m$^2$ and a burn adjusting agent in an amount of 3% by weight or more.

DETAILED DESCRIPTION OF THE INVENTION

The present invention will now be described in more detail.

The cigarette of the present invention comprises a tobacco section including a tobacco filler rod wrapped with a predetermined inner wrapper paper sheet and a predetermined outer wrapper paper sheet. An ordinary filter may be attached to one end of the tobacco section.

Of the wrapper paper sheets wrapping the tobacco filler rod of the present invention, the inner wrapper paper sheet has a calcium carbonate content of less than 4% by weight, and thus does not substantially contain calcium carbonate. When the inner wrapper paper contains calcium carbonate in an amount of 4% by weight or more, the burn rate of the resultant cigarette becomes excessively high, and therefore the amount of the sidestream smoke per unit time cannot be significantly decreased. It is preferable that the inner wrapper paper does not contain calcium carbonate.

The pulp that constitutes the inner wrapper paper sheet may be any type pulp as long as it is a pulp that is usually employed for a wrapper paper sheet of a smoking article, such as flax pulp. It is preferable that the amount of pulp is 10 to 18 g/m$^2$. When the amount of pulp is less than 10 g/m$^2$, there is a tendency that it becomes difficult to stably manufacture the wrapper paper. On the other hand, when the amount of pulp exceeds 18 g/m$^2$, there is a tendency that the flavor of the cigarette becomes unfavorable.

As the air permeability of the inner wrapper paper sheet becomes lower, the amount of sidestream smoke of the resultant cigarette per unit time is further decreased. It is preferable that the air permeability of the inner wrapper paper sheet is 1 to 30 CORESTA units (CU), and more preferably, 6 CU to 30 CU.

The inner wrapper paper sheet may contain a burn adjusting agent, but the amount thereof is preferably up to 1% by weight (0 to 1% by weight). If the amount of the burn adjusting agent exceeds 1% by weight, there is a tendency that the resultant cigarette cannot maintain a preferable burn rate of 6 mm/minute or higher, which will be described later.

The burn adjusting agent added to the inner wrapper paper sheet can be selected from alkali metal salts of organic acids such as sodium citrate, potassium citrate, sodium acetate, potassium acetate, sodium tartrate, potassium tartrate, sodium malate, potassium malate, sodium succinate, potassium succinate and the like.

The outer wrapper paper sheet employed in the present invention contains calcium carbonate in an amount of 30 g/m$^2$ or more and a burn adjusting agent in an amount of 3% by weight or more. When the amount of calcium carbonate is less than 30 g/m$^2$ and/or the amount of the burn adjusting agent is less than 3% by weight, the effect of reducing the amount of the sidestream smoke is not sufficiently exhibited. It is preferable that calcium carbonate is contained in an amount of 30 g/m$^2$ or more and 50 g/m$^2$ or less, and the burn adjusting agent is contained in the wrapper paper in an amount of 3 to 15% by weight.

As the burn adjusting agent used in the outer wrapper paper sheet, alkali metal salts of citric acid are preferably used. Of these, potassium citrate and sodium citrate are particularly preferable. These materials can be used singly or in combination.

The pulp that constitutes the outer wrapper paper sheet may be of the same type as that used for the inner wrapper paper sheet. It is preferable that the amount of pulp is 20 to 50 g/m$^2$.

Further, it is preferable that the outer wrapper paper sheet has a basis weight of 50 g/m$^2$ to 100 g/m$^2$.

In the present invention, calcium carbonate is added in the form of grains. The grain diameter can be selected arbitrarily in consideration of cost and easiness of making paper, but it should preferably be 0.02 μm to 10 μm.

The cigarette of the present invention, which has the tobacco section doubly wrapped with the inner wrapper paper sheet and the outer wrapper paper sheet, is small in the sidestream smoke amount per unit time, but also in the sidestream smoke amount per cigarette. The outer wrapper paper sheet, which contains a relatively large amount of calcium carbonate, has a high combustibility. When it is combined with the inner wrapper paper sheet, which does not substantially contain calcium carbonate, the burn rate becomes lower than the case where the outer wrapper paper sheet is employed solely, the amount of the sidestream smoke per unit time is decreased, and the amount of the sidestream smoke per cigarette is significantly decreased, too. It is preferable that the burn rate of the cigarette of the present invention is about 6 mm/minute or higher, and more preferably, 7 mm/minute or higher. Such a burn rate can be achieved by setting the content of the burn adjusting agent of the inner wrapper paper sheet to 0 to 1% by weight as described above. The burn rate of the cigarette of the present invention is usually no more than about 12 mm/minute. It should be noted that the burn rate of a cigarette can be measured by an ordinary fishtail method.

The present invention will now be described by way of Examples; however it is not limited to these Examples.

EXAMPLES 1-4 AND COMPARATIVE EXAMPLES 1-3

Cigarettes of the structure below were prepared.

<Specification of Cigarettes>

Size: FSK slim (circumference of 22.9 mm, length of the tobacco section of 68 mm, length of the filter of 30 mm and length of the tipping paper of 37 mm)

Cut tobacco: American blend, 0.565 g/cigarette

<Specification of Outer Wrapper Paper>

Amount of pulp: 30 g/m$^2$

Amount of calcium carbonate: 30 g/m$^2$

Amount of citrate: 4.5% by weight

<Specification of Inner Wrapper Paper>

As indicated in Table 1 below.

With regard to each of the cigarettes, the amount of the sidestream smoke (total particulate matter) was measured (for a burned length of 58 mm) together with the burn rate by the fishtail method. Thus, the amount of the sidestream smoke per unit time (mg/min) and the amount of the sidestream smoke per cigarette (mg/cigarette) were calculated. The results are shown also in Table 1.

TABLE 1

| | Specification of inner wrapper paper | | | | | Cigarette | | | |
|---|---|---|---|---|---|---|---|---|---|
| | | Calcium carbonate | | Air | | Amount of sidestream smoke | | Burn time Second | Burn |
| Example No. | Pulp g/m$^2$ | g/m$^2$ | % by weight | permeability CU | Sodium citrate % by weight | mg/cig | mg/min | (burn length of 58 mm) | rate mm/min |
| Comp. Ex. 1 | No inner wrapper paper (outer wrapper paper only) | | | | | 15.5 | 2.5 | 372 | 9.354 |
| Comp. Ex. 2-1 | 15 | 5 | 25 | 33 | 0.0 | 14.7 | 2.4 | 371 | 9.380 |
| Comp. Ex. 2-2 | | | | | 3.9 | 14.1 | 2.3 | 377 | 9.230 |
| Comp. Ex. 2-3 | | | | | 8.2 | 13.9 | 2.2 | 389 | 8.946 |
| Comp. Ex. 2-4 | | | | | 13.6 | 13.9 | 2.0 | 427 | 8.149 |
| Comp. Ex. 3-1 | 15 | 0.6 | 4 | 34 | 0.0 | 14.0 | 2.0 | 429 | 8.111 |
| Comp. Ex. 3-2 | | | | | 0.7 | 13.7 | 1.9 | 442 | 7.873 |
| Comp. Ex. 3-3 | | | | | 1.3 | 13.6 | 1.8 | 449 | 7.750 |
| Comp. Ex. 3-4 | | | | | 2.4 | 13.6 | 1.8 | 464 | 7.500 |
| Example 1-1 | 15 | 0.3 | 2 | 30 | 0.0 | 13.6 | 1.7 | 470 | 7.404 |
| 1-2 | | | | | 0.8 | 13.3 | 1.6 | 497 | 7.002 |
| 1-3 | | | | | 1.8 | 13.2 | 1.5 | 519 | 6.705 |
| 1-4 | | | | | 2.5 | 13.2 | 1.4 | 548 | 6.350 |
| Example 2-1 | 15 | 0 | 0 | 31 | 0.0 | 13.6 | 1.6 | 506 | 6.877 |
| 2-2 | | | | | 0.9 | 13.0 | 1.5 | 537 | 6.480 |
| 2-3 | | | | | 1.8 | 13.2 | 1.4 | 556 | 6.258 |
| 2-4 | | | | | 2.6 | 13.0 | 1.3 | 587 | 5.928 |
| Example 3-1 | 15 | 0 | 0 | 15 | 0.0 | 13.4 | 1.5 | 524 | 6.641 |
| 3-2 | | | | | 0.7 | 13.0 | 1.4 | 543 | 6.408 |
| 3-3 | | | | | 1.8 | 12.9 | 1.4 | 571 | 6.094 |
| 3-4 | | | | | 2.6 | 12.9 | 1.3 | 593 | 5.868 |
| Example 4-1 | 15 | 0 | 0 | 6 | 0.0 | 13.3 | 1.5 | 543 | 6.408 |
| 4-2 | | | | | 0.7 | 12.6 | 1.3 | 563 | 6.181 |
| 4-3 | | | | | 1.7 | 12.5 | 1.3 | 582 | 5.979 |
| 4-4 | | | | | 2.4 | 12.4 | 1.2 | 598 | 5.819 |

As can be seen from the results shown in Table 1, the cigarettes of the present invention each indicated a significant decrease in amounts of sidestream smoke both per unit time and per cigarette. In particular, as compared to the cigarette wrapped with the outer wrapper paper sheet only (Comparative Example 1), the amount of the sidestream smoke per unit time and the amount of the sidestream smoke per cigarette of the cigarette of the present invention are remarkably reduced. Further, it is understood from the comparison between the cigarettes of the present invention and those of Comparative Examples 3-1 to 3-4 that the amount of the sidestream smoke per unit time and the amount of the sidestream smoke per cigarette of the cigarette of the present invention are remarkably reduced when the amount of calcium carbonate contained in the inner wrapper paper sheet is set to less than 4% by weight. Furthermore, each of the cigarettes of the present invention exhibited a burn rate of about 6 mm/min or more and showed a significant decrease in both of the amount of the sidestream smoke per unit time and the amount of the sidestream smoke per cigarette.

Various embodiments of the present invention have been described above; however the invention is not limited to these embodiments. Needless to mention, the above-described embodiments can be combined appropriately.

According to the present invention, there is provided a cigarette small not only in the amount of sidestream smoke per unit time but also in the amount of sidestream smoke per cigarette.

What is claimed is:

1. A cigarette comprising a tobacco section including a tobacco filler rod wrapped with an inner wrapper paper sheet containing less than 4% by weight of calcium carbonate and 0 to 1% by weight of a burn adjusting agent, and an outer wrapper paper sheet containing calcium carbonate in an amount of 30 $g/m^2$ or more and a burn adjusting agent in an amount of 3% by weight or more, wherein the inner wrapper paper sheet has an air permeability of 6 to 30 CORESTA units, such that the cigarette exhibits a burn rate of 6 to 7 mm/minute when measured by a fishtail method.

2. The cigarette according to claim 1, wherein the inner wrapper paper sheet contains pulp in an amount of 10 to 18 $g/m^2$.

3. The cigarette according to claim 1, wherein the burn adjusting agent contained in the inner wrapper paper sheet is selected from the group consisting of sodium citrate, potassium citrate, sodium acetate, potassium acetate, sodium tartrate, potassium tartrate, sodium malate, potassium malate, sodium succinate and potassium succinate.

4. The cigarette according to claim 1, wherein the outer wrapper paper sheet contains up to 50 $g/m^2$ of calcium carbonate.

5. The cigarette according to claim 1, wherein the outer wrapper paper sheet contains up to 15 $g/m^2$ of the burn adjusting agent.

6. The cigarette according to claim 1, wherein the burn adjusting agent contained in the outer wrapper paper sheet is selected from the group consisting of potassium citrate and sodium citrate.

7. The cigarette according to claim 1, wherein the outer wrapper paper sheet contains pulp in an amount of 20 to 50 $g/m^2$.

8. The cigarette according to claim 1, wherein the outer wrapper paper sheet has a basis weight of 50 to 100 $g/m^2$.

* * * * *